US006416380B1

(12) United States Patent
Li-Wen

(10) Patent No.: US 6,416,380 B1
(45) Date of Patent: Jul. 9, 2002

(54) MOTION TOY

(75) Inventor: Chi Li-Wen, Hsien (TW)

(73) Assignee: Blue Ridge Designs Inc., Boone, NC (US)

( * ) Notice: Subject to any disclaimer, the term of this patent is extended or adjusted under 35 U.S.C. 154(b) by 0 days.

(21) Appl. No.: 09/755,959

(22) Filed: Jan. 5, 2001

(30) Foreign Application Priority Data

Oct. 11, 2000 (TW) ..... 98217597 U
Oct. 25, 2000 (CN) ..... 00257504 U

(51) Int. Cl.[7] ..... A63H 11/00; A63H 13/00

(52) U.S. Cl. ..... 446/353; 446/354; 446/384; 446/330

(58) Field of Search ..... 446/330, 301, 446/353, 354, 298, 300, 358, 352, 391; 40/218, 614, 411, 902, 412, 414, 415, 416, 417, 418, 419, 427, 429, 430, 431, 432, 433, 440, 456, 457, 466, 479, 493, 511, 524, 530

(56) References Cited

U.S. PATENT DOCUMENTS 674,970 A 5/1901 Kennedy
711,510 A 10/1902 Little
1,415,344 A 5/1922 Haskell
1,423,383 A 7/1922 Zaiden
1,483,127 A 2/1924 Starbuck
1,674,943 A 6/1928 Berger
1,685,358 A 9/1928 Harcourt
2,637,936 A 5/1953 Dale et al. ..... 46/120
2,691,845 A 10/1954 Jepson ..... 46/120
3,452,473 A 7/1969 Convertine ..... 49/119
3,613,299 A 10/1971 Amici et al. ..... 46/120
3,643,374 A 2/1972 Gunther et al. ..... 46/139
3,660,931 A 5/1972 Gardel et al. ..... 46/120
3,721,040 A 3/1973 Goldfarb ..... 46/119
3,775,900 A * 12/1973 Thorn et al. ..... 46/120
3,888,023 A 6/1975 Genin ..... 35/29 R
4,040,206 A 8/1977 Kimura ..... 46/138
4,071,249 A * 1/1978 Goldfarb et al. ..... 273/161
4,073,088 A * 2/1978 Beny et al. ..... 46/265
4,545,775 A 10/1985 Kim ..... 446/299
4,560,362 A 12/1985 Renger ..... 446/340
4,676,764 A 6/1987 Yeu ..... 446/298
4,723,932 A 2/1988 Kelley et al. ..... 446/330
4,801,285 A 1/1989 Yeu ..... 446/298
4,828,530 A 5/1989 Lee ..... 446/354
4,836,819 A 6/1989 Oishi et al. ..... 446/288
4,846,752 A 7/1989 Combs ..... 446/279
4,867,730 A 9/1989 Lee ..... 446/353
4,869,703 A 9/1989 Ong ..... 446/353
4,875,886 A 10/1989 Sung ..... 446/298
4,878,878 A 11/1989 Bittner ..... 446/139
4,901,459 A 2/1990 Lee ..... 40/414
4,944,708 A 7/1990 Kawabe ..... 446/175
5,121,646 A 6/1992 Cho ..... 74/23
5,147,238 A 9/1992 Kelley et al. ..... 446/330
5,176,560 A 1/1993 Wetherell et al. ..... 446/175
5,224,896 A * 7/1993 Terzian ..... 446/355
5,259,806 A 11/1993 Chang ..... 446/270
5,413,517 A 5/1995 Kamijima ..... 446/354
5,609,340 A 3/1997 Chuang ..... 273/448
5,735,726 A 4/1998 Cohen ..... 446/298
5,911,617 A 6/1999 Chou ..... 446/353
6,017,261 A 1/2000 Wachtel ..... 446/301
6,071,170 A 6/2000 How ..... 446/330

OTHER PUBLICATIONS

U.S. Patent Application Serial No. 09/852,548, filed May 10, 2001, entitled Multiple Motion Toy.

* cited by examiner

*Primary Examiner*—Jessica Harrison
*Assistant Examiner*—Aiex F. R. P. Rada, II
(74) *Attorney, Agent, or Firm*—Myers Bigel Sibley & Sajovec

(57) ABSTRACT

A motion toy includes a body member and a head member mounted on the body member. A head drive system is operable to rotate the head member simultaneously up-and-down and side-to-side relative to the body member.

16 Claims, 20 Drawing Sheets

MOTION TOY

CROSS-REFERENCE TO RELATED APPLICATIONS

This application claims priority to Taiwanese Application No. 89217597, filed Oct. 11, 2000, and Chinese Application No. 00257504-3, filed Oct. 25, 2000, the disclosures of which are hereby incorporated herein by reference.

FIELD OF THE INVENTION

The present invention relates to toys and, more particularly, to motion toys.

BACKGROUND OF THE INVENTION

Motion toys have been disclosed which use a motor to turn a transmission gear train, which in turn moves eccentric rods or cams so as to move one or more movable parts of the toy back and forth. An example of such a motion toy is shown in FIGS. 15 and 16 herein, which employs a fan-shaped gear to move the structure about six axes of motion to provide left and right oscillating motion of the body and legs of the toy. A similar motion toy is disclosed in U.S. Pat. No. 5,911,617 to Chou, the disclosure of which is hereby incorporated herein by reference in its entirety. However, there is a need for a motion toy which provides different and more entertaining movements and combinations of movements.

SUMMARY OF THE INVENTION

The present invention is directed to motion toys. Motion toys according to the invention include a toy head that rotates side-to-side and also rotates up-and-down. The combination of simultaneous side-to-side and up-and-down movements as provided by the motion toy of the present invention may provide a natural and entertaining motion. Motion toys according to the invention may also include a toy leg that rocks up-and-down. In this manner, the toy may provide particularly interesting composite rocking movements.

According to preferred embodiments of the present invention, a motion toy includes a body member and a head member mounted on the body member. A head drive system is operable to rotate the head member simultaneously up-and-down and side-to-side relative to the body member.

Preferably, the head drive system is operable to rotate the head member side-to-side about a first axis and to simultaneously rotate the head member up-and-down about a second axis. The second axis is transverse to the first axis and varies as the head member rotates about the first axis.

Preferably, the head drive system includes a stationary member and a rocking member pivotally connected to the stationary member for relative rotation about the first axis. The rocking member includes a head pivot post. The head member is connected to the head pivot post for relative rotation about the second axis. A drive unit is operable to pivot the rocking member about the head pivot post relative to the stationary member about the first axis and to simultaneously rotate the head member relative to the rocking member about the second axis.

The head drive system may further include a curved rack rail on the stationary member and a wheel pivotally connected to the rocking member for rotation about a third axis. The wheel includes a gear meshed with the rack rail for rotation therealong and an eccentric pivot post extending from the wheel along a fourth axis substantially parallel to and offset from the third axis. A linkage connects the eccentric pivot post and the head member. The drive unit is operable to rotate the wheel about the third axis whereby the eccentric pivot post is rotated about the third axis and drives the head member up and down via the linkage.

The rack rail may have a profile including a convex section and a concave section. Alternatively, the rack rail may have a uniformly arcuate, convex profile.

Preferably, the linkage includes a linking arm that is driven up-and-down by the eccentric pivot post as the eccentric pivot post rotates about the third axis. The linkage may further include a linking member joining and pivotally connected to each of the linking arm and the eccentric pivot post. The linkage may include a rocker arm connected to the head member and pivotally connected to each of the linking arm and the head pivot post.

The motion toy may further include a leg drive system. The leg drive system includes a drive gear and a leg member each pivotally connected to the body member. A linking arm connects the drive gear and the leg member. A drive unit is operable to pivot the drive gear back-and-forth whereby the leg member is rocked relative to the body.

Objects of the present invention will be appreciated by those of ordinary skill in the art from a reading of the figures and the detailed description of the preferred embodiments which follow, such description being merely illustrative of the present invention.

BRIEF DESCRIPTION OF THE DRAWINGS

The accompanying drawings, which are incorporated in and constitute a part of the specification, illustrate embodiments of the invention and, together with the description, serve to explain principles of the invention.

FIGS. 11A–11G are front schematic views of the head drive system of the toy of FIG. 1 illustrating the movements thereof, wherein the head is removed for clarity.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As used herein, the terms "pivot rod" or the like may refer to a simple pin, a pin having a shaft and an enlarged head on one or both ends, a rivet, a bolt and nut combination, or the like.

Figure 1:
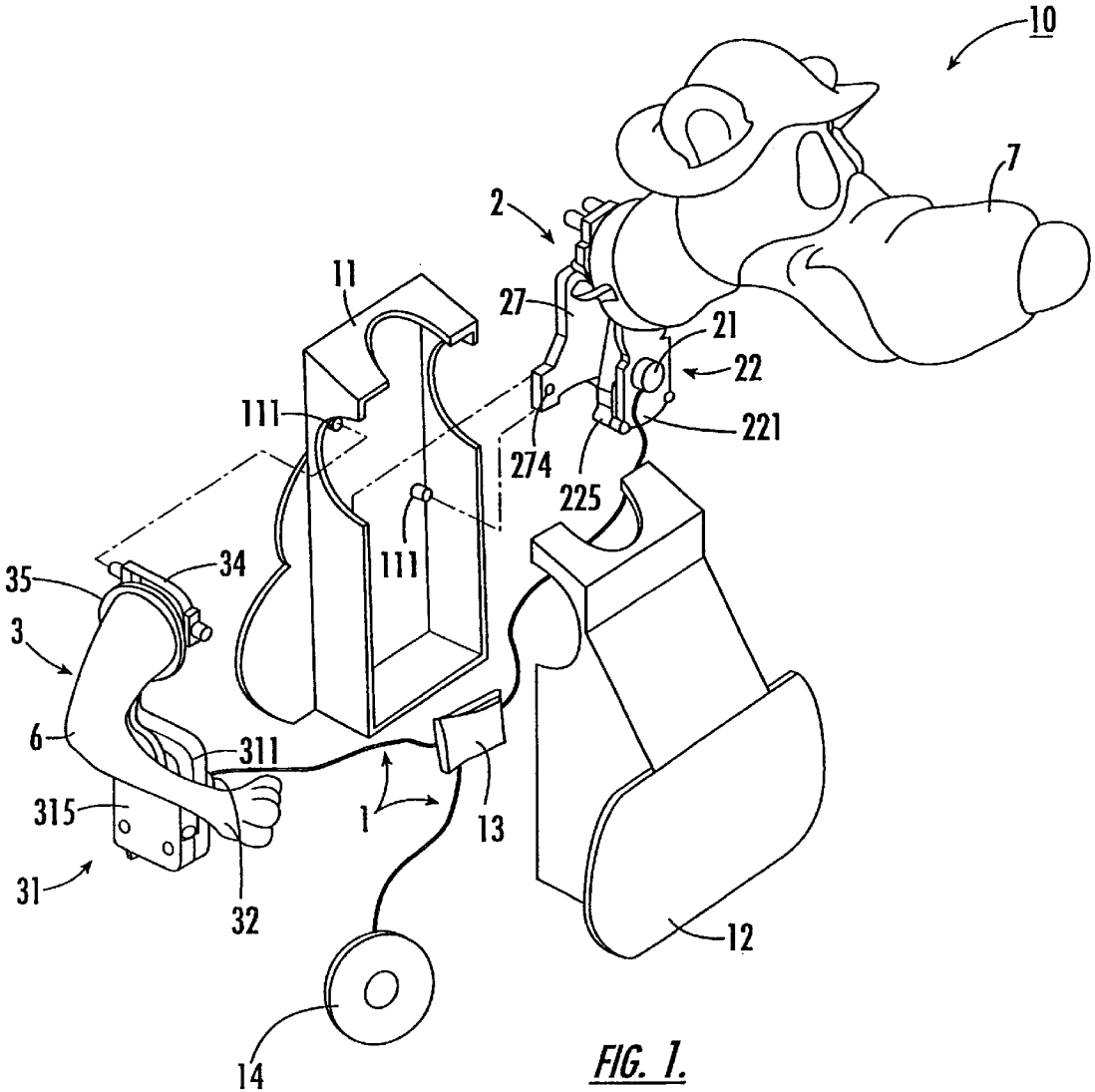
FIG. 1 is an exploded, perspective view of a motion toy according to preferred embodiments of the present invention.
Figure 2:
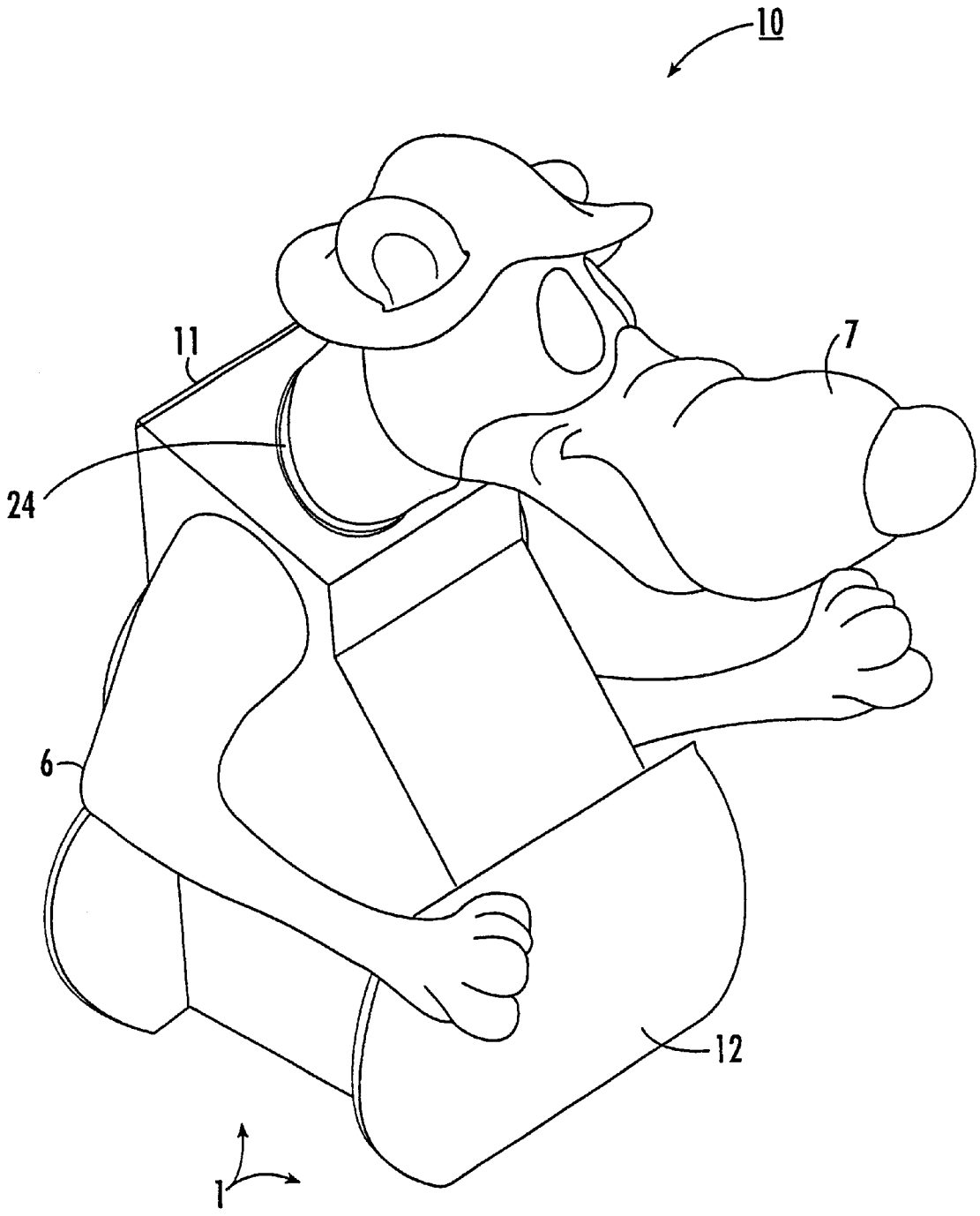
FIG. 2 is perspective view of the toy of FIG. 1.

With reference to FIGS. 1 and 2, a motion toy 10 according to preferred embodiments of the present invention is shown therein. The toy 10 includes generally a stand 1, a head drive system 2, a leg drive system 3 (optionally, a second leg drive system 3 may be provided, only one of which is shown in FIG. 1), a toy head 7 and a pair of toy arms or legs 6. Clothing or the like may also be mounted over the toy 10. The toy 10 is constructed such that, upon actuation, the head 7 is moved simultaneously up-and-down and side-to-side while the legs 6 are moved up-and-down. This combination of movements may provide a particularly attractive and interesting display.

With reference to FIGS. 1 and 2, the stand 1 includes a rear cover 11 and a front cover 12 secured together (e.g., by means of adhesive and/or fasteners) as shown in FIG. 2 to form a body. A plurality of mounting posts 111 forming a part of the rear cover 11 extend inwardly therefrom and serve to locate and support the head drive system 2 and the leg drive system 3 as discussed in more detail below.

As best seen in FIGS. 3–6, the head drive system 2 includes a transmission assembly 22. The transmission assembly 22 includes a drive motor 21, preferably a relatively compact electrical motor with a suitable power supply (not shown). A suitable microprocessor 13 or the like is provided to control the operation of the motor 21. The motor 21 has a drive shaft 211 that extends through an opening 2213 in a first rocking member 221 and engages a drive wheel 227. The drive wheel 227 is connected to a first gear 222 by a belt 228. The first gear 222 meshes sequentially with a second gear 223 and a third gear 224.

A drive rod 2241 (FIG. 4) extends through an opening 2251 in a second rocking member 225 and connects the third gear 224 with an eccentric wheel 226 positioned on the opposed side of the rocking member 225. The drive rod 2241 defines an axis of rotation F—F about which the wheel 226 may rotate. The rocking member 225 is secured to the rocking member 221 by suitable fasteners 47 to provide a housing or cover enclosing the several gears and the belt.

The wheel 226 has an eccentrically located (i.e., with respect to the axis F—F) post 2261 extending from the rear face thereof and an eccentrically located gear 2262 (see FIGS. 10A–10C) extending from the front face thereof. That is, neither the post 2261 nor the gear 2262 is concentric with the drive rod 2241. The post 2261 defines an axis G—G (FIG. 4) that extends parallel to but is offset from the axis F—F.

Figure 3:
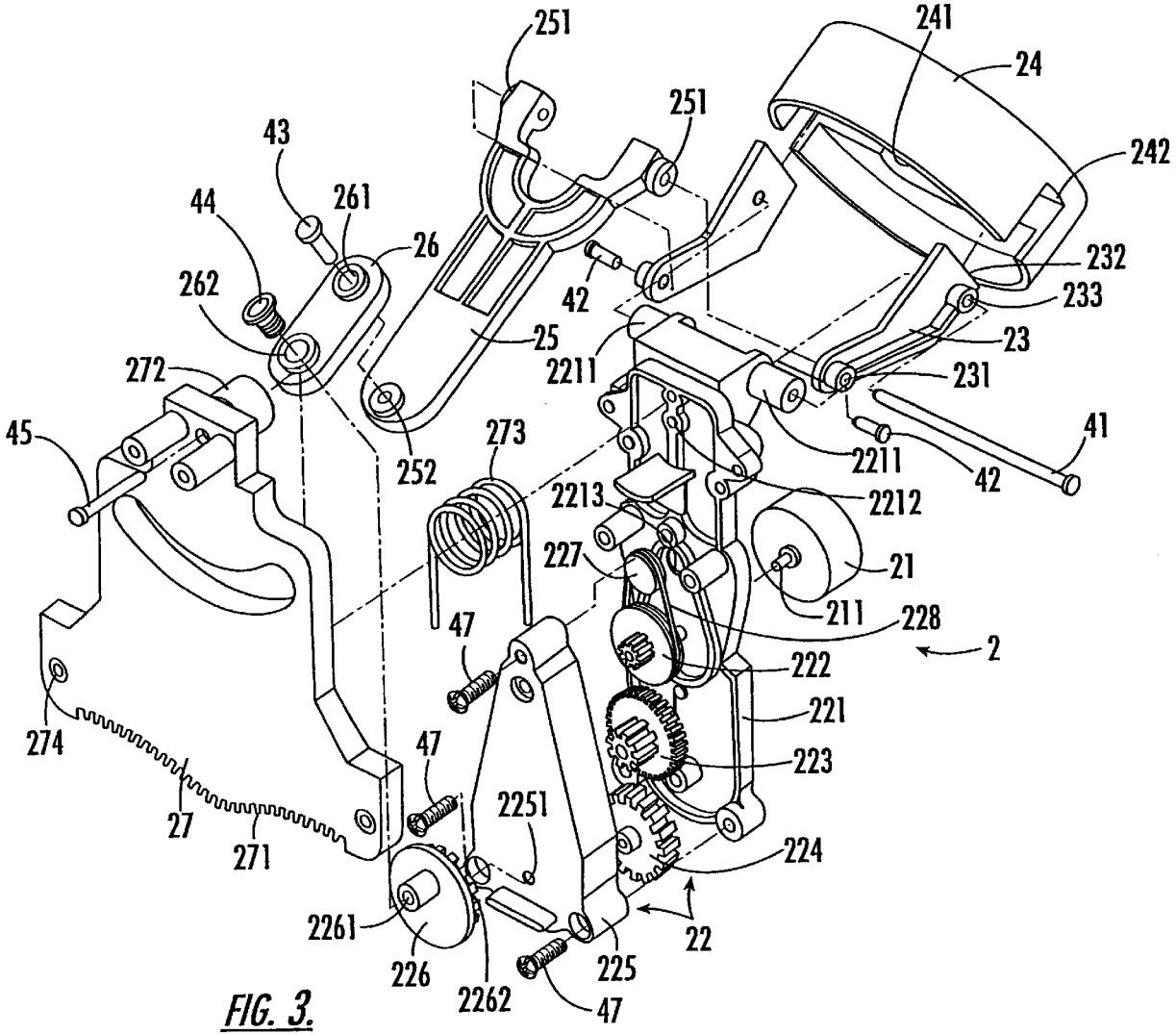
FIG. 3 is an exploded, perspective view of a head drive system of the toy of FIG. 1.

A pair of generally V-shaped rocker arms 23 are provided (FIG. 3). Each of the rocker arms 23 has a hollow post 233 and a fastening end 232. The fastening ends 232 are securely received in positioning slots 241 (see FIG. 10A) in a neck seat 24 such that the posts 233 project outwardly from opposing notches 242 in the neck seat 24. The rocker arms 23 and neck seat 24 may be integrally formed. Two head pivot posts 2211 extend from opposing sides of the rocking member 221 at the upper end thereof. The rocker arms 23 are pivotally connected to the upper end of the rocking member 221 by a pivot rod 41 that extends through the posts 2211 and the posts 233.

The toy head 7 is secured (e.g., by adhesive and/or fasteners) to the upper surface of the neck seat 24. Alternatively, the toy head 7 may be integrally formed with the neck seat 24 to provide a unitary head member. The toy head 7 preferably simulates the head of an animal, character or the like.

The transmission 22 also has a linkage including a generally Y-shaped linking arm 25 and a linking member 26. The linking arm 25 includes a pair of opposed posts 251 on the upper end thereof. The posts 251 are positioned between and pivotally connected to the rocker arms 23 by pivot rods 42 that extend through the posts 251 and respective posts 231 formed on the rocker arms 23 opposite the posts 233. The linking arm 25 is pivotally connected at its lower end to the linking member 26 by a connector rod 43 that extends through an opening 261 in the linking member 26 and an opening 252 in the linking arm 25.

Figure 5:
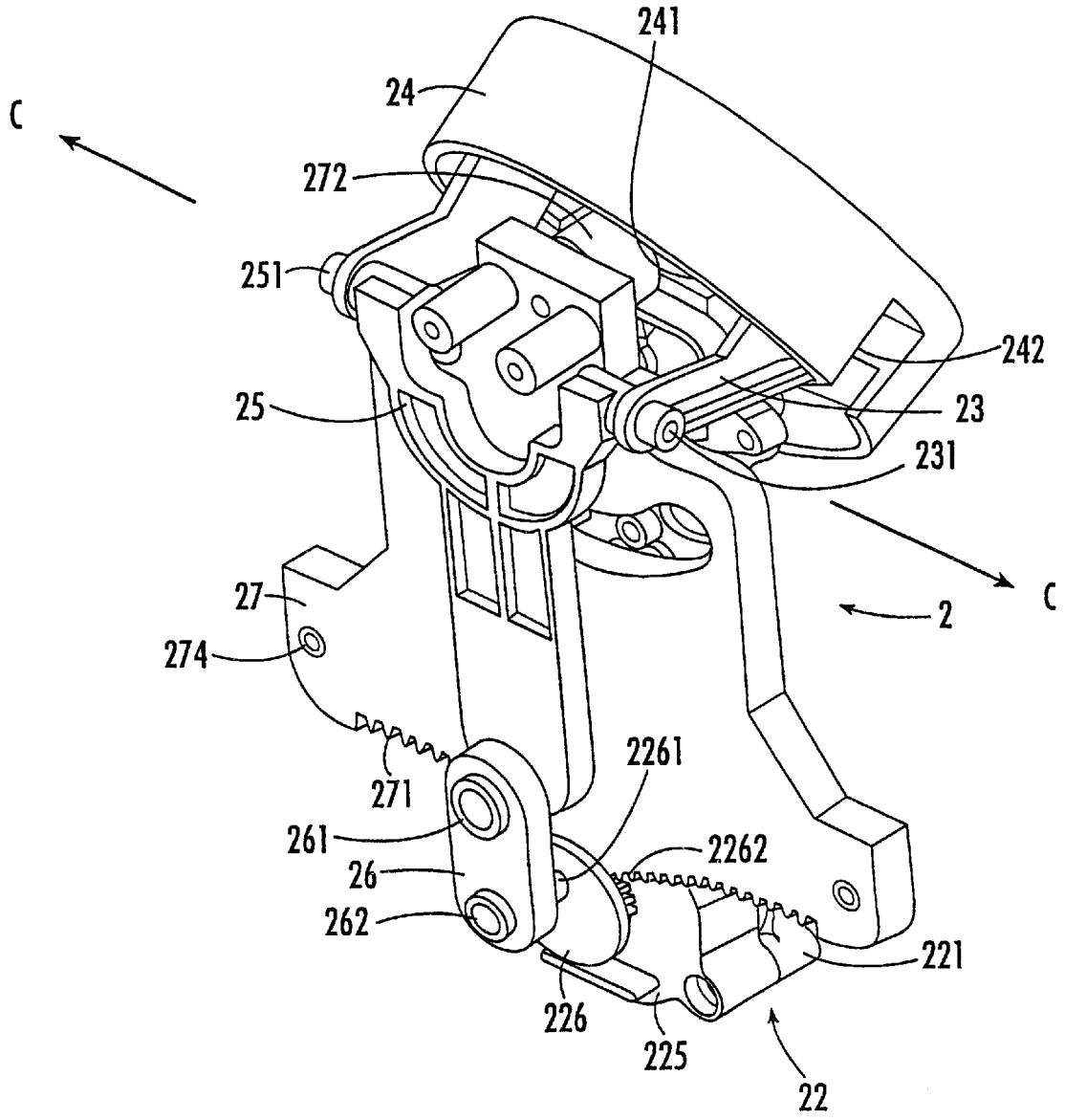
FIG. 5 is a perspective view of the head drive system of FIG. 3.
Figure 6:
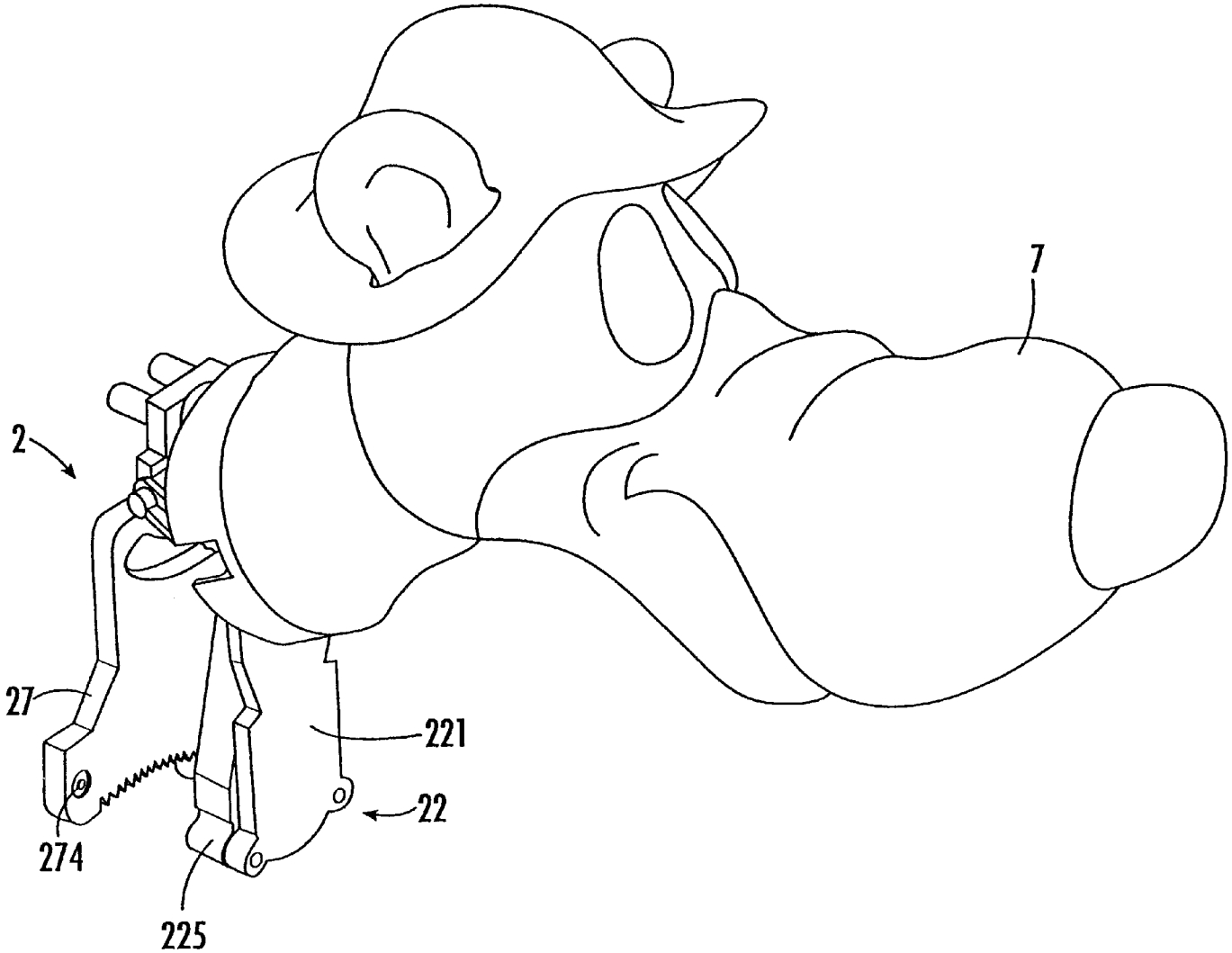
FIG. 6 is a perspective view of the head drive system of FIG. 3 with a toy head mounted thereon.

The lower end of the linking member 26 is pivotally connected to the eccentric post 2261 of the wheel 226 by a connecting rod 44 (FIGS. 3 and 5). The connecting rod 44 extends through an opening 262 in the linking member 26 and into the end of the eccentric post 2261.

The transmission assembly 22 further includes a stationary member 27. A curved rack rail 271 is formed on the lower edge of the stationary member 27. The profile of the curved rack rail 271 is a waveform including concave and convex sections as illustrated. The curved rack rail 271 meshes with the eccentric gear 2262 (see FIG. 5). A pivot post 272 extends forwardly from the stationary member 27 and into a brake spring 273. The pivot post 272 is pivotally joined to a pivot connection hole 2212 in the rocking member 221 by a rod 45.

The head drive system 2 is secured in the stand 1 by the lower pair of the posts 111. As best seen in FIG. 1, the posts 111 are positioned in or adjacent mounting holes 274 in the stationary member 27 and may be secured in position by fasteners.

Figure 7:
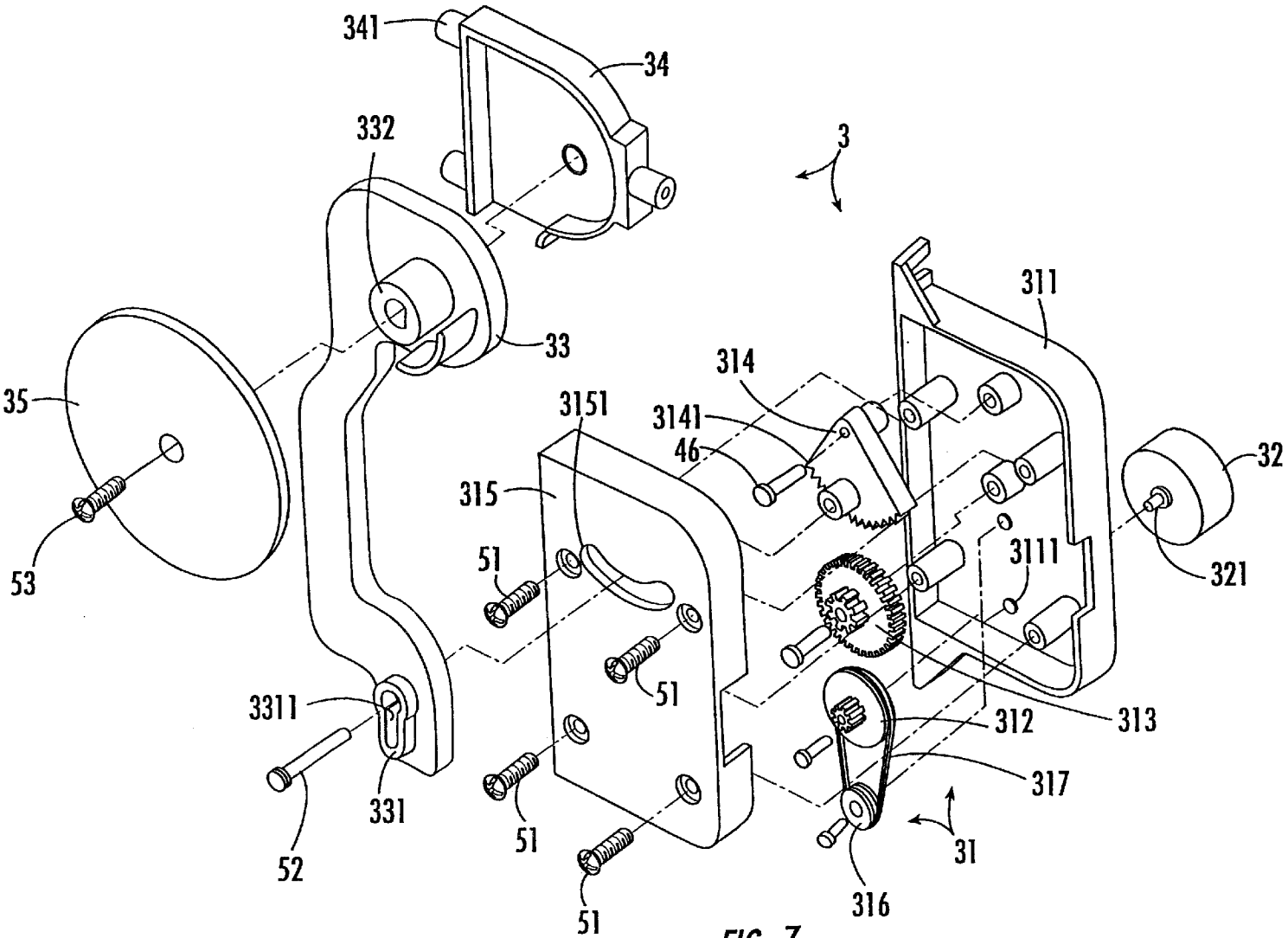
FIG. 7 is an exploded, perspective view of a leg drive system of the toy of FIG. 1.
Figure 8:
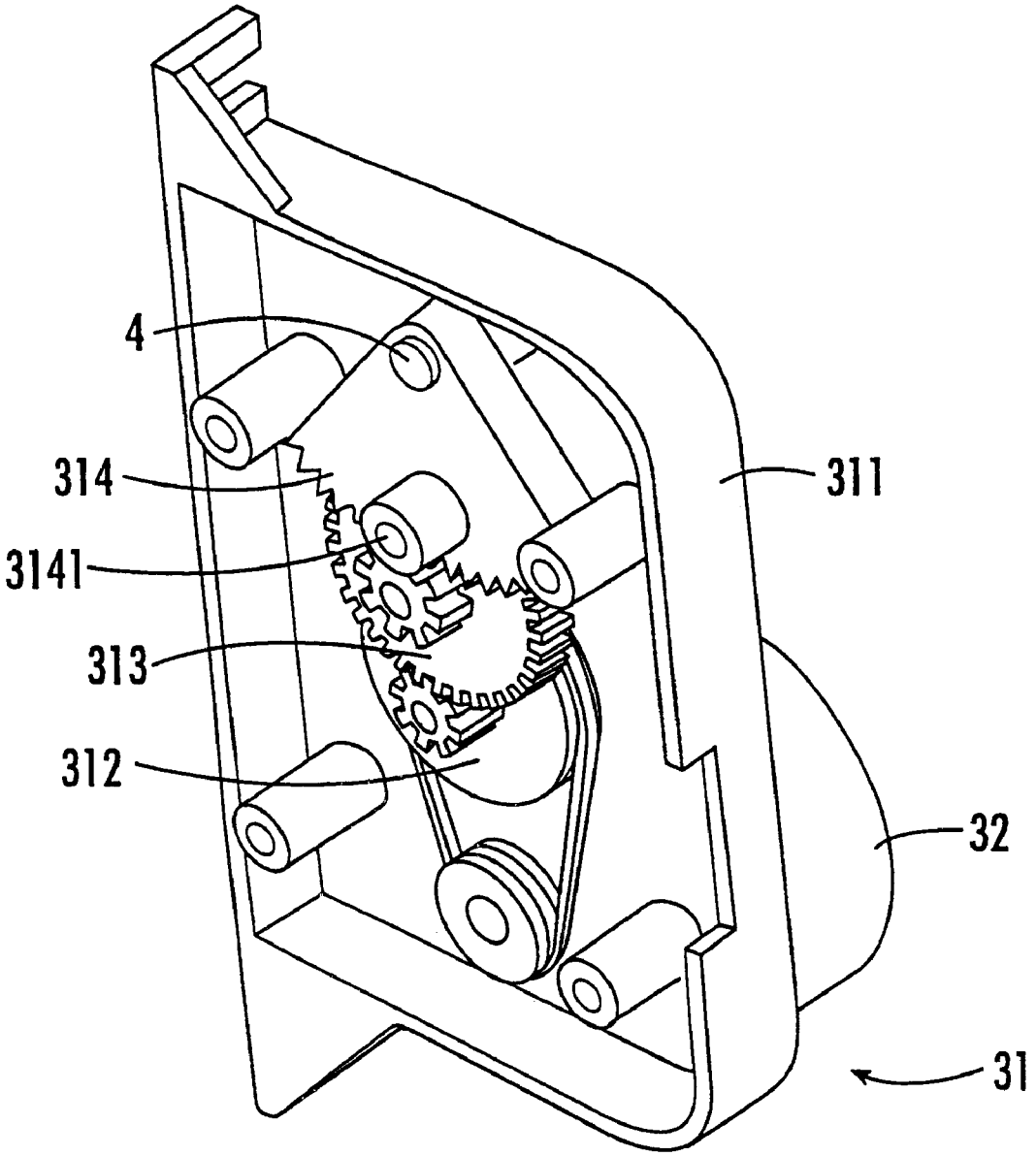
FIG. 8 is a perspective view of a transmission assembly of the leg drive system of FIG. 7.
Figure 9:
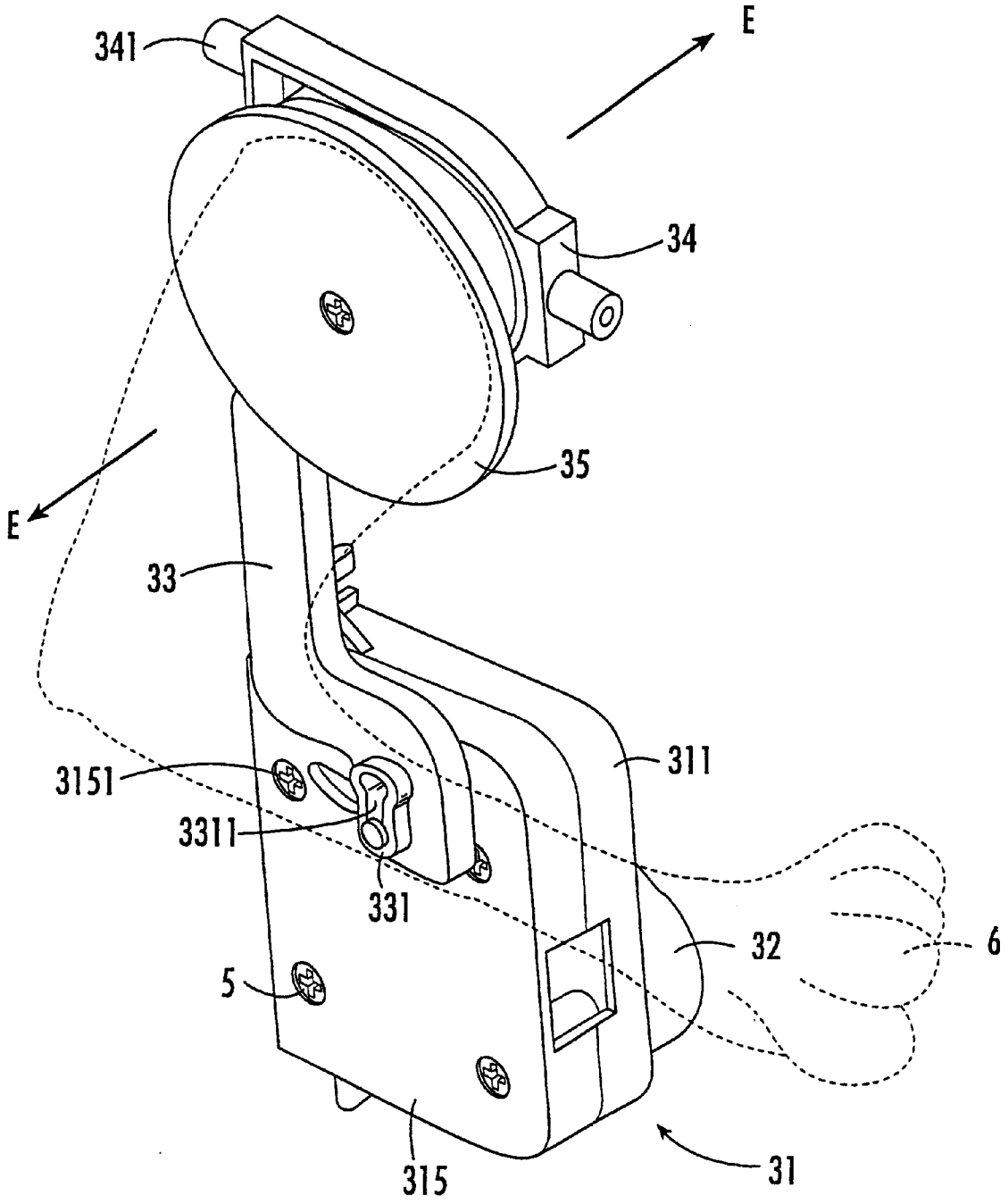
FIG. 9 is a perspective view of the leg drive system of FIG. 7.

With reference to FIGS. 7–9, the leg drive system 3 includes a transmission assembly 31. The transmission assembly 31 has an inner cover 311 and an opposing, outer cover 315 joined together by fasteners 51 to form a housing. A second motor 32 is positioned on the inner side of the cover 311. Preferably, the microprocessor 13 also controls the operation of the motor 32. The motor 32 has a drive shaft 321 that extends through an opening 3111 in the cover 311 and engages a drive wheel 316. A belt 317 connects the drive wheel 316 to a first gear 312. The first gear 312 sequentially engages a second gear 313 and a sector gear 314.

The sector gear 314 is pivotally joined to the cover 311 by a pivot rod 46. The sector gear 314 has an outwardly extending eccentric axle post 3141. The front cover 315 has an arc-shaped slot 3151. The eccentric axle post 3141 of the sector gear 314 extends through the arc-shaped slot 3151. A pivot rod 52 extends through a generally vertical slot 331 formed in the lower end of a linking arm 33.

A positioning shaft 332 extends from the upper end of the linking arm 33. A pivot rod 53 secures a cover member 34 to the inner side of the linking arm 33 and also secures a disk 35 to the outer side of the linking arm 33. The disk 35 is mounted for rotation with the linking arm 33. The cover member 34 is mounted to allow the linking arm 33 to rotate independently of the cover member 34 about the pivot rod 53. A toy leg 6 is secured to the outer surface of the disk 35 by adhesive and/or fasteners. The toy leg 6 preferably simulates a leg (e.g., an arm) of an animal or character of the type simulated by the toy head 7.

The leg drive system 3 is secured in the stand 1 by the upper pair of the posts 111. As best seen in FIG. 1, the posts 111 are positioned adjacent positioning shafts 341 of the cover member 34 and may be secured in position by fasteners. The positioning shaft 341 on the front side of the cover member 34 may be secured to the front cover 12.

The second leg drive system, if provided, may be a generally mirror image of the leg drive system described above and illustrated in FIGS. 7–9. The second leg drive system 3 preferably includes a second motor corresponding to the motor 32 which is controlled independently of the motor 32 such that the toy legs 6 move up-and-down independently of one another.

The toy 10 may be formed of any suitable materials. For example, with the exception of the motors 21, 32, the components of the toy 10 may be formed of a polymeric material. For clarity, certain fasteners or other securing means (e.g., adhesives) are not shown in the drawings. The appropriate locations for placement of such fasteners and suitable types of fasteners will be apparent to those of ordinary skill in the art upon reading the description herein.

With reference to FIGS. 10A–12C, the head drive system 2 generates the aforementioned up-and-down movement and side-to-side movement of the neck seat 24 in the following manner.

The motor 21 is alternatingly actuated and reversed to rotate the drive shaft 211 clockwise and counterclockwise. The motor 21 thereby rotates the wheel 226 via the wheel 227, the gears 223, 224 and the belt 228. The eccentric gear 2262 is thereby driven such that it revolves back and forth along the rack rail 271. The convex and concave profile of the rack rail 271 accommodates the eccentrically positioned gear 2262 as the gear 2262 rolls along the rack rail 271 so that a constant vertical distance is maintained between the drive rod 2241 (FIG. 4) and the rack rail 271. In this manner, the rotation of the gear 2262 is converted to translational movement and the rocking member 221, the rocking member 225 (FIG. 4), the linking arm 25, the rocker arms 23, the neck seat 24 and the head 7 are rotated back and forth about the axis B—B (FIG. 4) of the pivot hole 2212 relative to the stationary member 27 and the stand 1. The spring 273 is mounted on the pivot post 272 such that spring legs 2731 engage a projection 2214 on the rocking member 221 and bias the rocking member 221 toward the fully vertical position.

Figure 4:
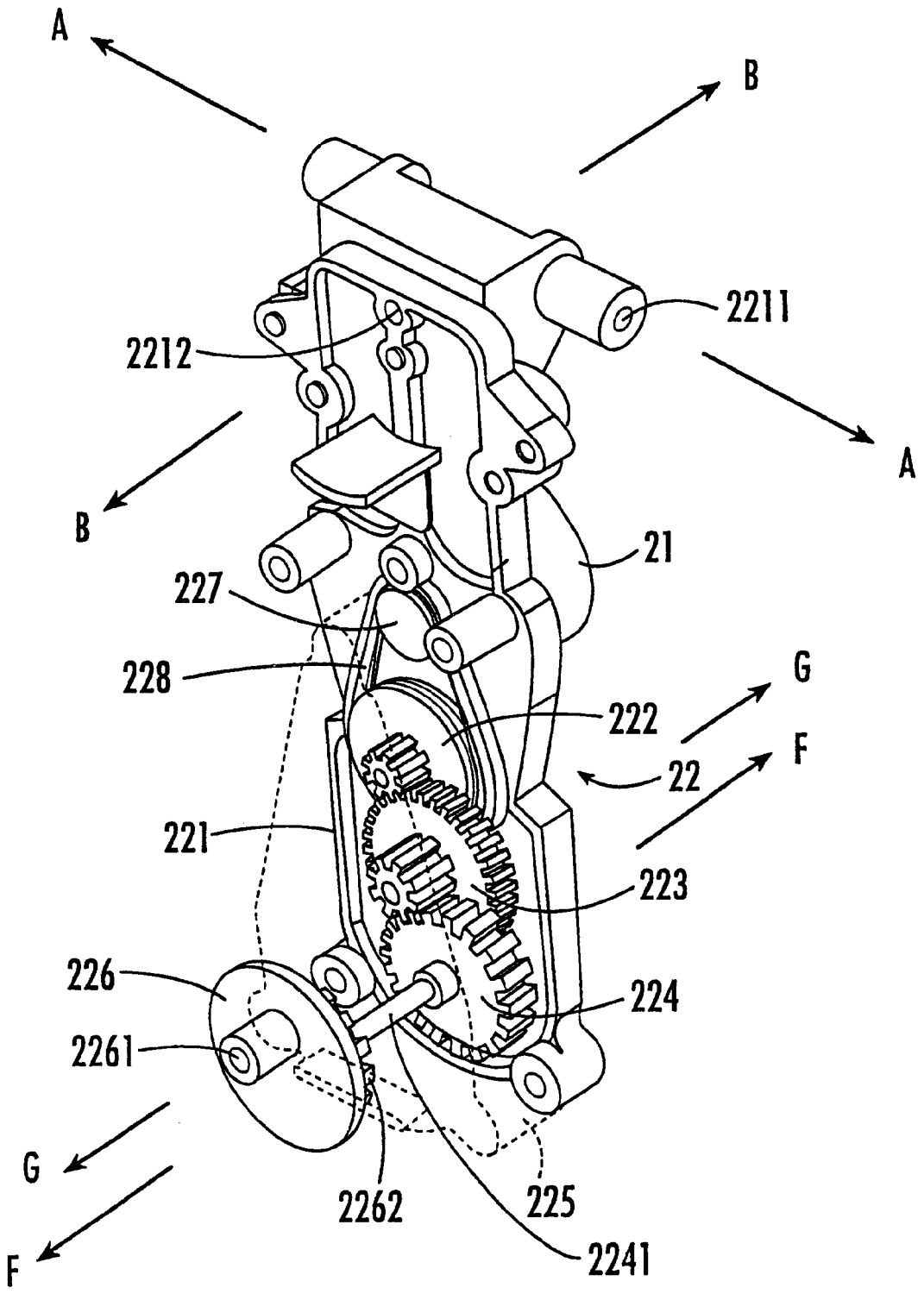
FIG. 4 is a perspective view of a transmission assembly of the head drive system of FIG. 3.

Additionally, as the gear 2262 rotates along the rack rail 271, the eccentric post 2261 moves upwardly and downwardly relative to the drive rod 2241 (i.e., the axis F—F; FIG. 4) and, hence, the rocking member 221. The eccentric post 2261 rotates within the opening 262 about the axis G—G (FIG. 4). The rotating eccentric post 2261 drives the linking member 26 and, in turn, the linking arm 25 up-and-down along the lengthwise axis D—D (FIGS. 10A–10C) of the linking arm 25. The linking arm 25 pivots the rocker arms 23 about the axis C—C (FIG. 5) of the posts 251 and about the axis A—A (FIG. 4) of the posts 2211. This rocking movement causes the neck seat 24 and the head 7 to pivot up-and-down about the axis A—A, which is transverse to the axis B—B. The side-to-side movement of the eccentric post 2261 is accommodated by the pivot rod 43.

Figure 10B:
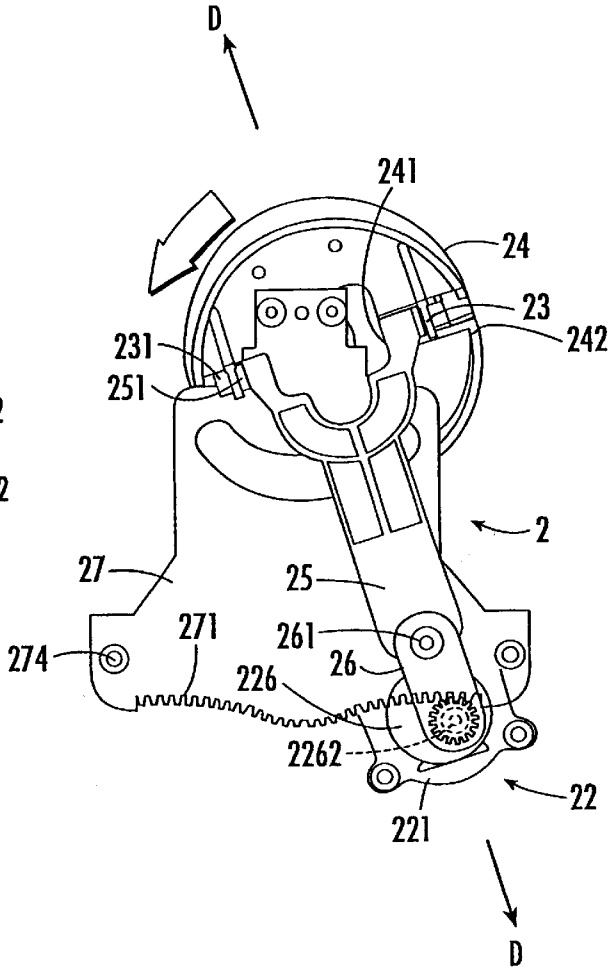
FIGS. 10A–10C are rear schematic views of the head drive system of the toy of FIG. 1 illustrating the movements thereof, wherein the head is removed for clarity.
Figure 10C:
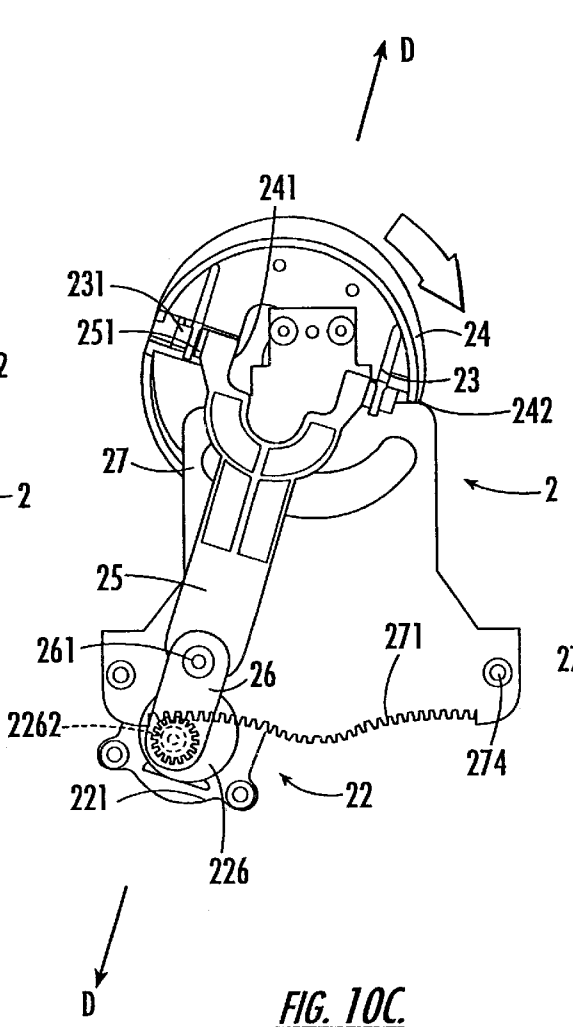
Figure 10A:
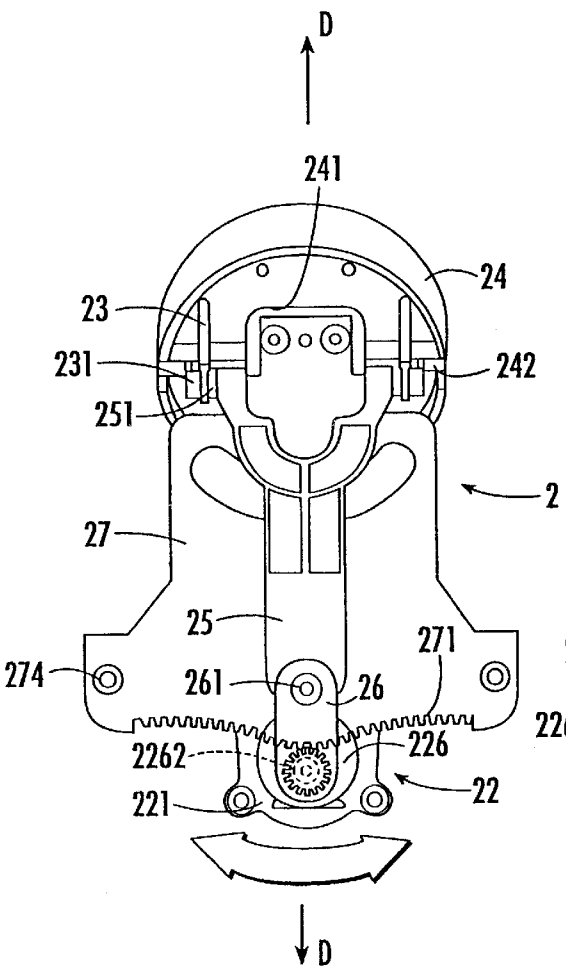
Figure 11C:
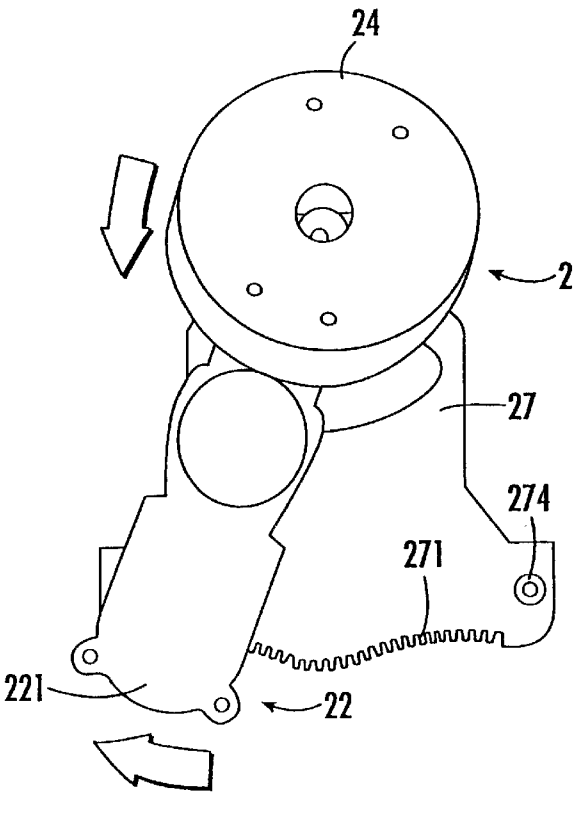
Figure 11B:
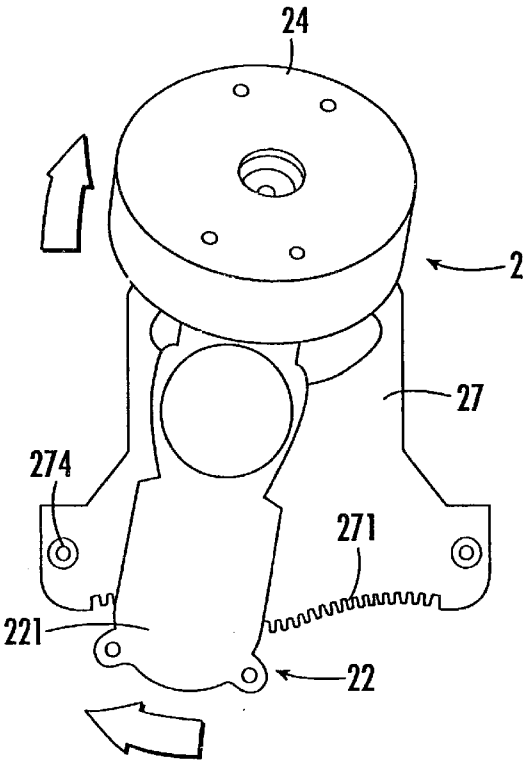
Figure 11A:
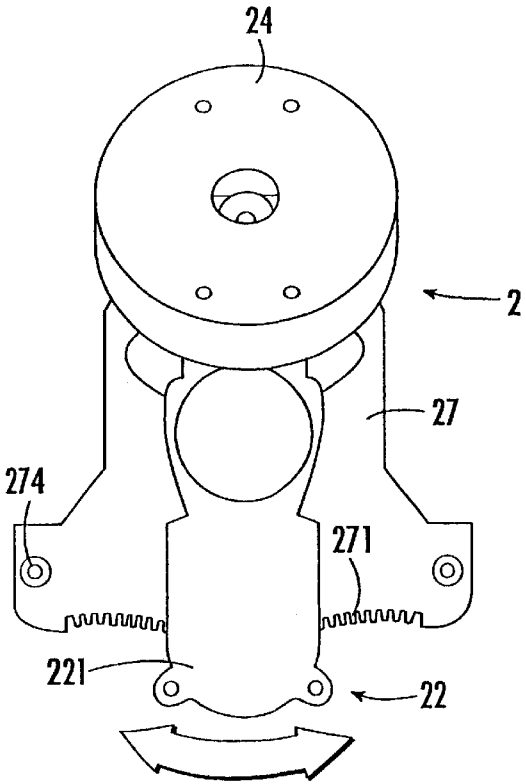
Figure 11E:
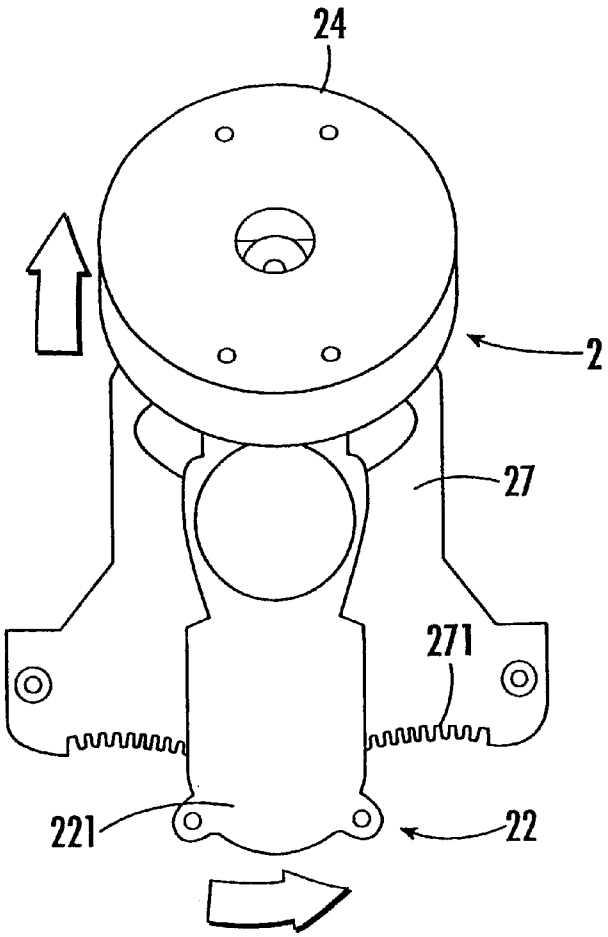
Figure 11D:
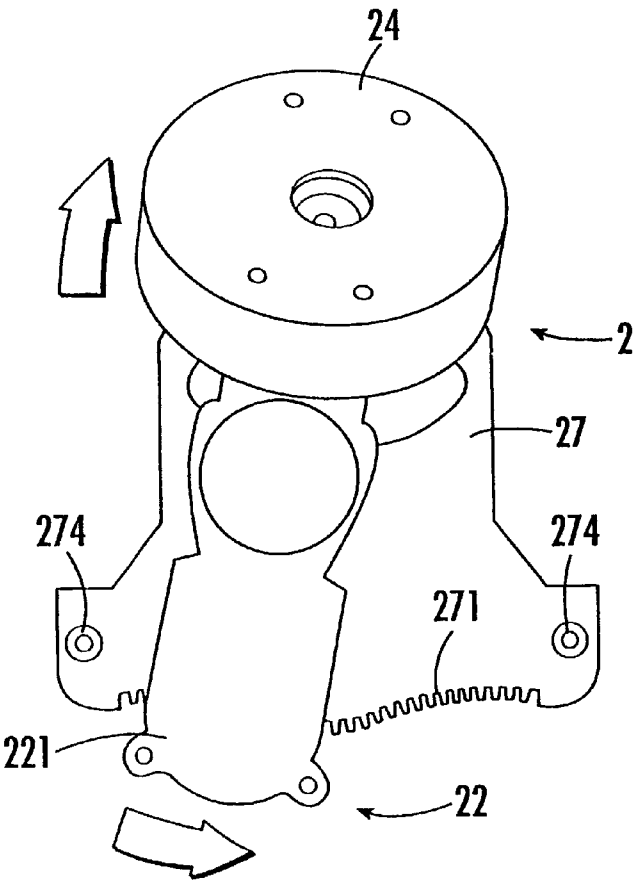
Figure 11G:
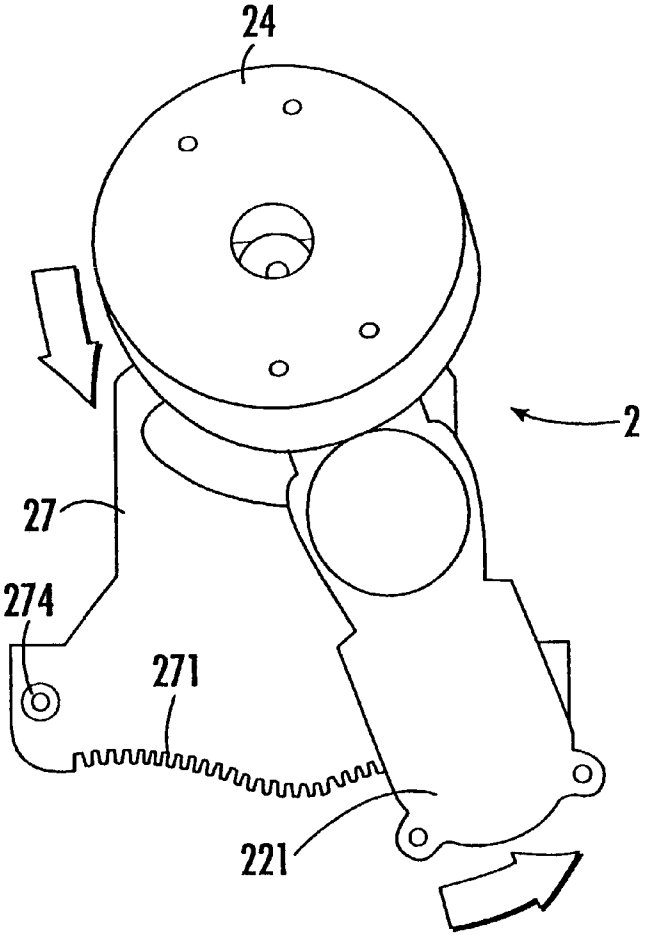
Figure 11E:
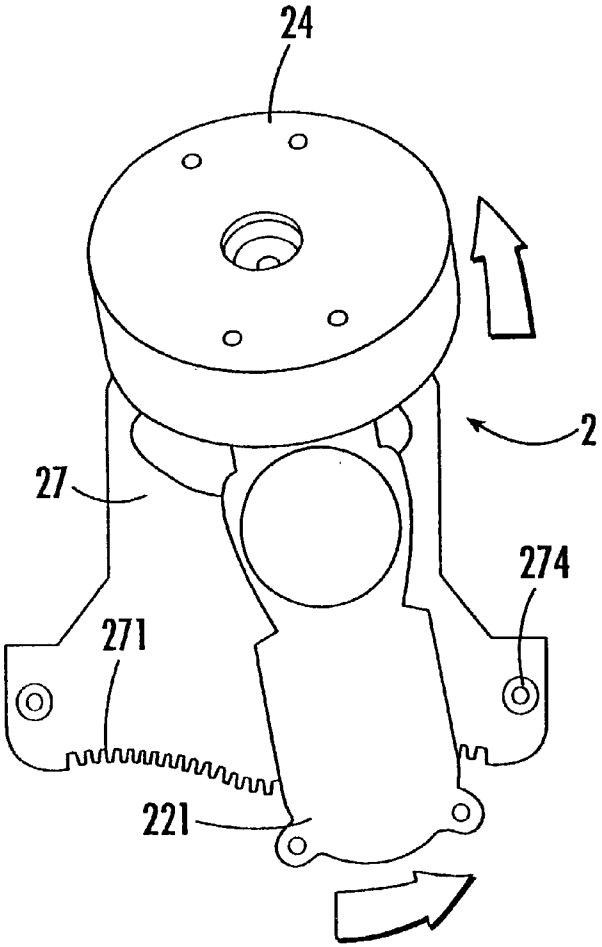
Figure 12C:
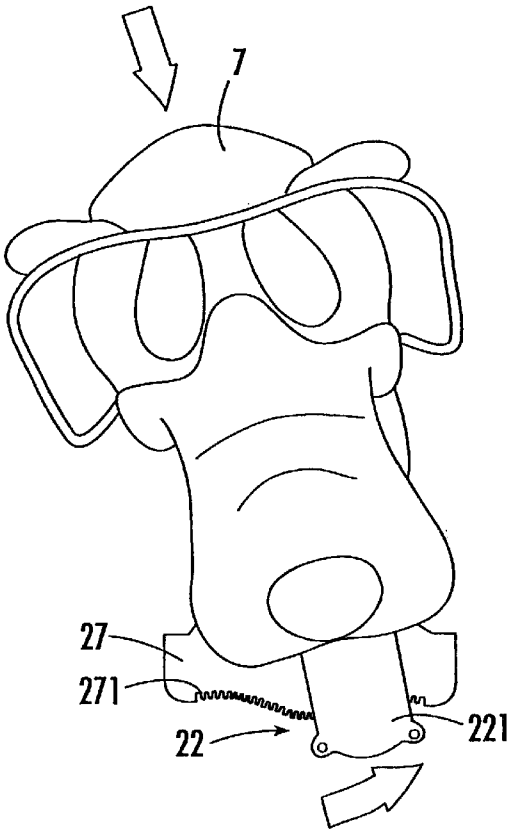
FIGS. 12A–12C are front schematic views of the head drive system of the toy of FIG. 1 illustrating the movements thereof.

The foregoing movements are manifested as a simultaneous combination of oscillating or reciprocating side-to-side and up-and-down movements of the head 7 as illustrated in FIGS. 10A–12C. FIGS. 10A–10C are rear, schematic views of the head drive system 2 in various operating positions, wherein the head 7 is removed for clarity. FIGS. 11A–11G are front, schematic views of the head drive system 2 in various operating positions, wherein the head 7 is removed for clarity. FIGS. 12A–12C are front, schematic views of the head drive system 2 in various operating positions, wherein the head 7 is illustrated.

Figure 12A:
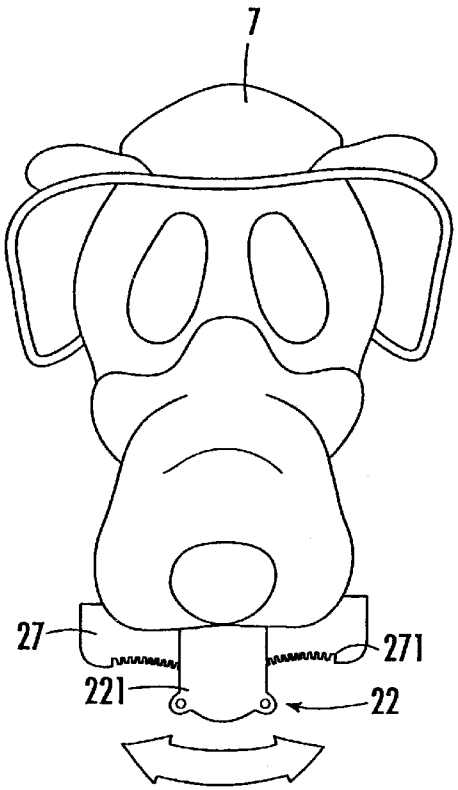
Figure 12B:
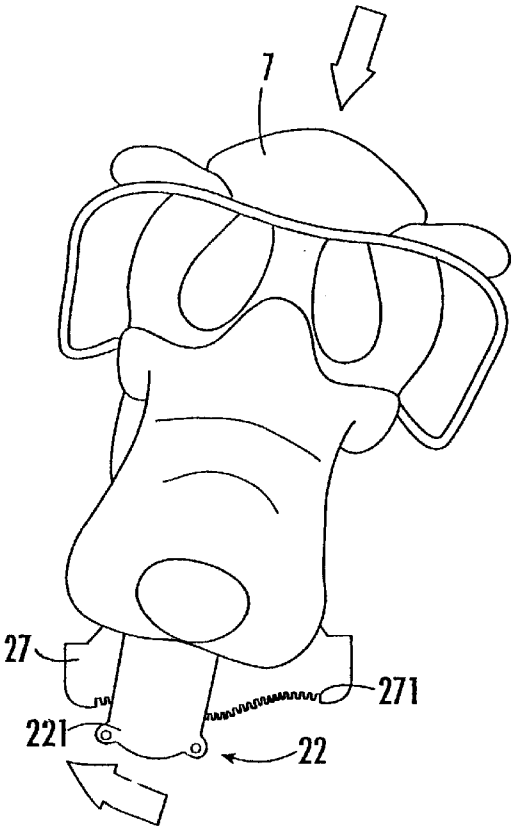

With reference to FIGS. 10A, 11A and 12A, the head drive system 2 is schematically illustrated therein in a centered position. As the motor 21 first drives the wheel 226 clockwise, the eccentric gear 2262 drives the rocking member 221 and the linking arm 25 leftward (as viewed from the front) relative to the stationary member 27 (and the stand 1 to which the stationary member 27 affixed) as shown in FIGS. 11B and 12B. The neck seat 24 (and, as referenced hereinafter, also the attached head 7) is thereby rotated rightward relative to the stand 1. Simultaneously, the neck seat 24 is tilted upward by the action of the eccentric post 2261 and the linking arm 25.

With reference to FIGS. 10B and 11C, as the motor continues to drive the wheel 226 clockwise, the neck seat 24 is further rotated rightward relative to the stand 1 to a rightmost position. Additionally, the neck seat 24 is simultaneously tilted downward by the action of the eccentric post 2261 and the linking arm 25.

With reference to FIG. 11D, the motor 21 then reverses and drives the wheel 226 counterclockwise. The neck seat 24 is thereby rotated leftward, and also tilted upward by the action of the eccentric post 2261.

With reference to FIG. 11E, as the motor 21 continues to drive the wheel 226 counterclockwise, the neck seat 24 is further rotated leftward relative to the stand 1 to return the neck seat 24 to the centered position. Additionally, the neck seat 24 is simultaneously further tilted upward by the action of the eccentric post 2261 and the linking arm 25.

With reference to FIG. 11F and 12C, as the motor 21 continues to drive the wheel 226 counterclockwise, the neck seat 24 is further rotated leftward relative to the stand 1. Additionally, the neck seat 24 is simultaneously tilted upward by the action of the eccentric post 2261 and the linking arm 25.

With reference to FIGS. 10C and 11G, as the motor continues to drive the wheel 226 clockwise, the neck seat 24 is further rotated leftward relative to the stand 1 to a leftmost position. Additionally, the neck seat 24 is simultaneously tilted downward by the action of the eccentric post 2261 and the linking arm 25.

The neck seat 24 can thereafter be returned to the centered position by again reversing the motor 21. The foregoing procedure may be repeated as desired. The motor may be temporarily stopped between movements. Also, the motor 21 may be reversed when the transmission 22 is in positions other than the leftmost and rightmost positions. For example, once the toy 7 has transitioned from the position of FIG. 11A to the position of FIG. 11B, the motor 21 may then be reversed to return to the position of FIG. 11A and then the position of FIG. 11F rather than completing the sweep to the leftmost position of FIG. 11C.

It will be appreciated by those of skill in the art from a reading of the description herein that the patterns and frequencies of up-and-down and side-to-side movements of the neck seat 24 as the wheel 226 traverses the rack rail 271 may be modified by changing the profile of the rack rail 271, modifying the diameter of the gear 2262, and/or relocating the gear 2262 and/or the pivot post 2261 on the wheel 226.

The above-described combination of simultaneous side-to-side and up-and down head movements provides an overall complex and natural head motion. As the head 7 rotates from side-to-side about the axis B—B, the orientation of the axis A—A varies, and may vary continuously. The toy may give the appearance that the head 7 is nodding and swinging. The effect is remarkable in that the head 7 may appear to move with unlimited degrees of freedom and smoothness in the same manner as the neck of a real animal such as a bear or a human.

Figure 13A:
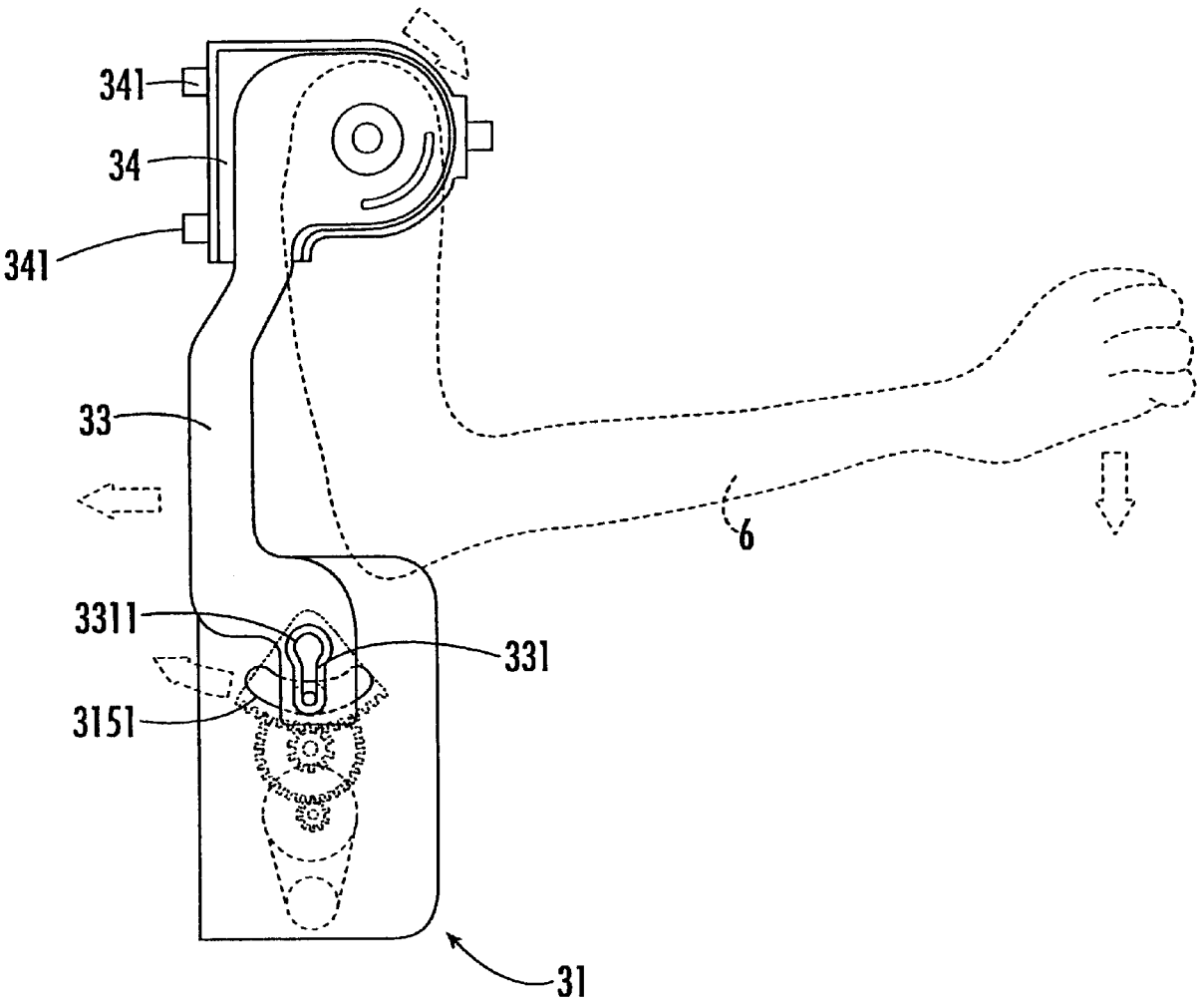
FIG. 13A is a schematic view of the leg drive system of the toy of FIG. 1.
Figure 13B:
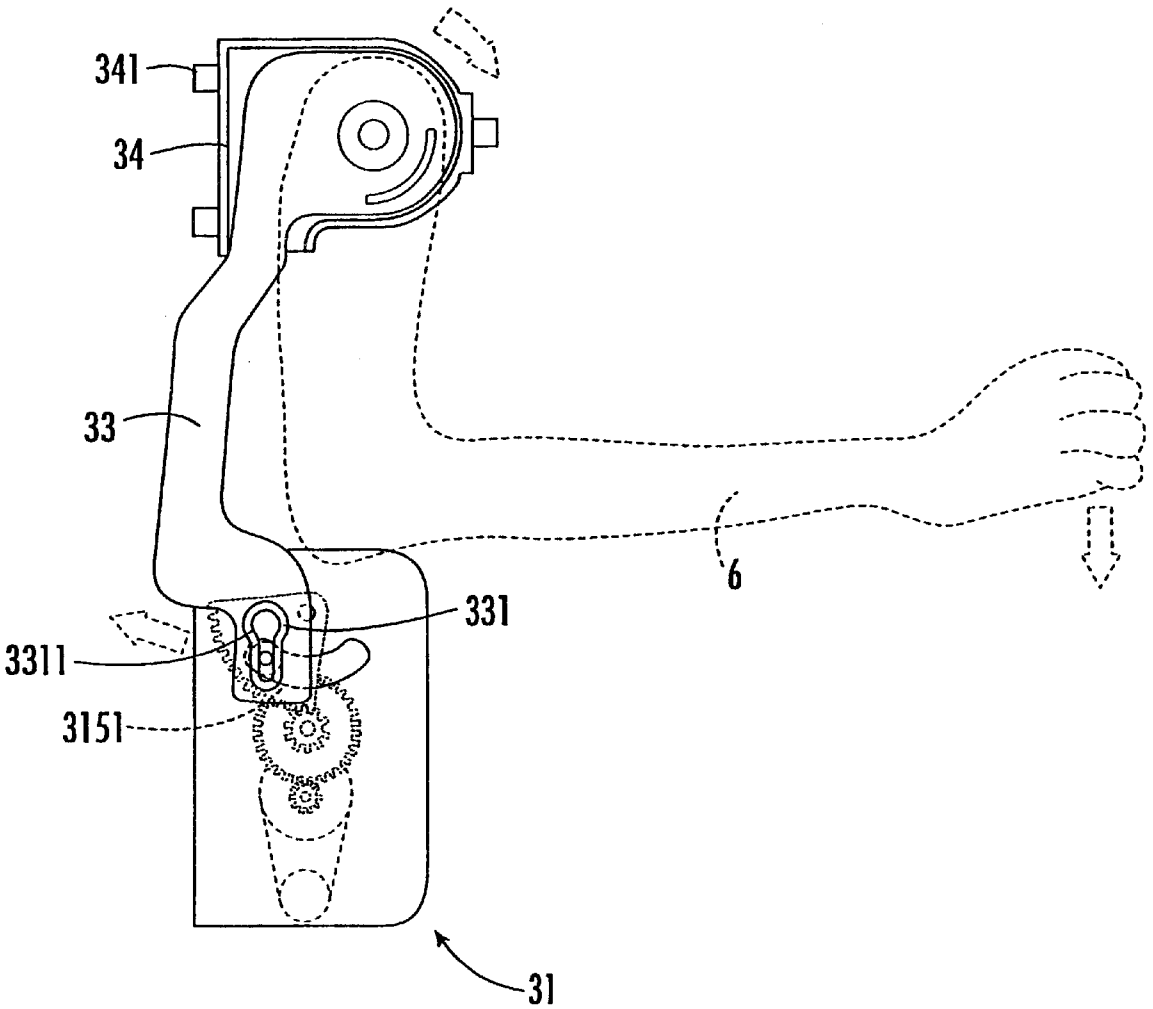
FIG. 13B is a schematic view of the leg drive system illustrating a downward rocking motion of the toy leg.
Figure 13C:
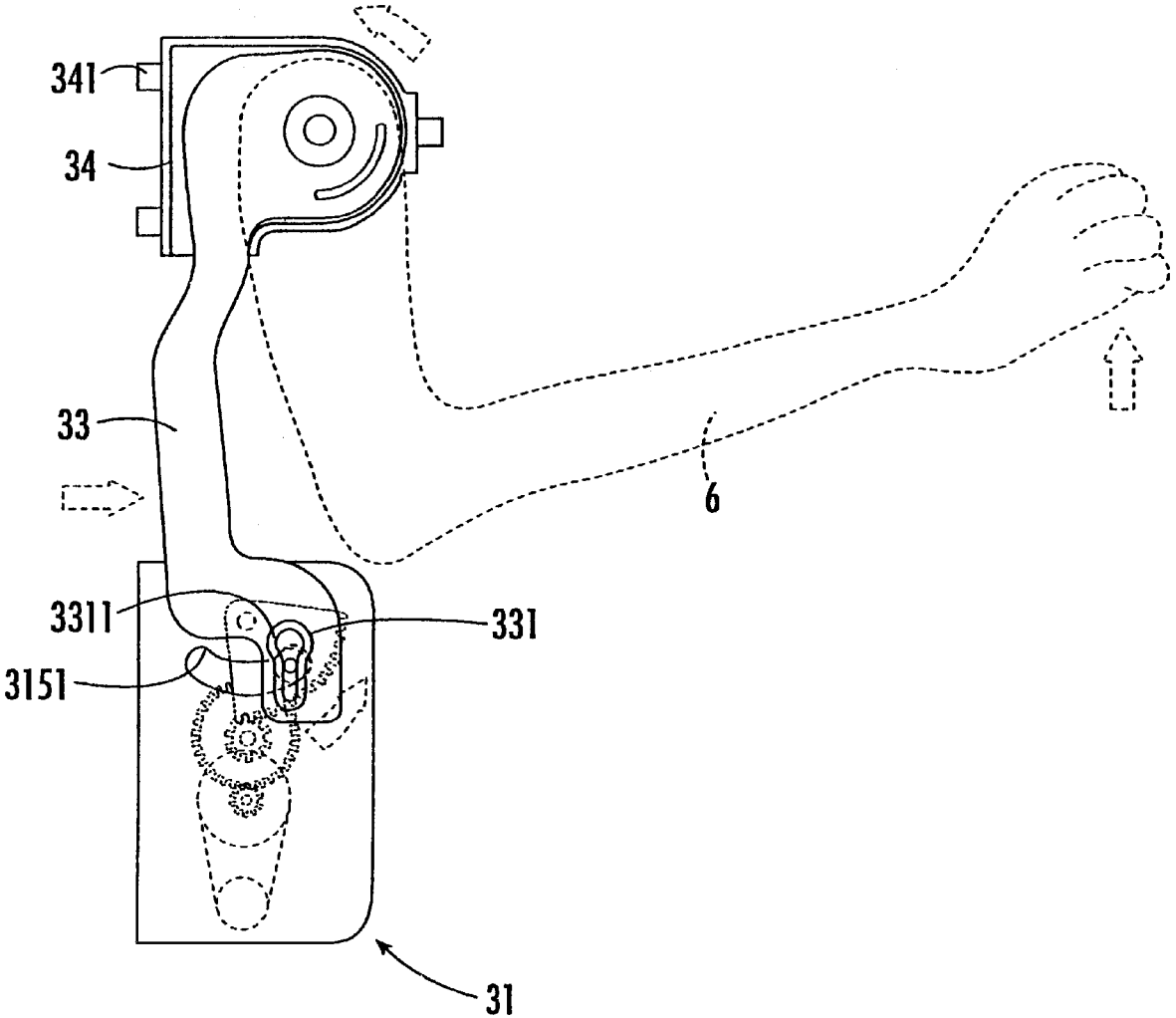
FIG. 13C is a schematic view of the leg drive system illustrating an upward rocking motion of the toy leg.

With reference to FIGS. 13A–13C, the leg drive system 3 generates the aforementioned up-and-down movement to the toy leg 6 in the following manner.

The motor 32 is alternatingly actuated and reversed to rotate the drive shaft 321 clockwise and counterclockwise. More particularly, the sector gear 314 is rocked back and forth about the pivot rod 46. The motor 32 thereby rotates the sector gear 314 via the wheel 316, the gears 312, 313 and the belt 317. The eccentric axle post 3141 of the sector gear 314 sweeps back and forth along an arcuate path within the arc-shaped slot 3151 as indicated by arrows in FIGS. 13B and 13C.

As the sector gear 314 rocks from side-to-side, the pivot rod 52 that pivotally connects the eccentric axle post 3141 with the brake hole 331 of the linking arm 33 pushes against the side wall 3311 of the brake hole 331. The linking arm 33 is thereby driven to pivot about the axis E—E (FIG. 9) defined by the positioning shaft 332. The drive disk 35 and the toy leg 6 rotate with the linking arm 33 relative to the stand 1 so that the toy leg 6 swings up-and-down alongside the stand 1. More particularly, the toy leg 6 is rotated from a neutral position as shown in FIG. 13A in a downward direction as indicated by the arrows in FIG. 13B to the lower position shown in FIG. 13B. Upon reversing the motor 32, the toy leg 6 is rotated in an upward direction as indicated by the arrows in FIG. 13C to the upper position shown in FIG. 13C. The leg 6 may thereafter be continuously reciprocated between the upper and lower positions by repeatedly reversing the direction of the motor 32.

Figure 14:
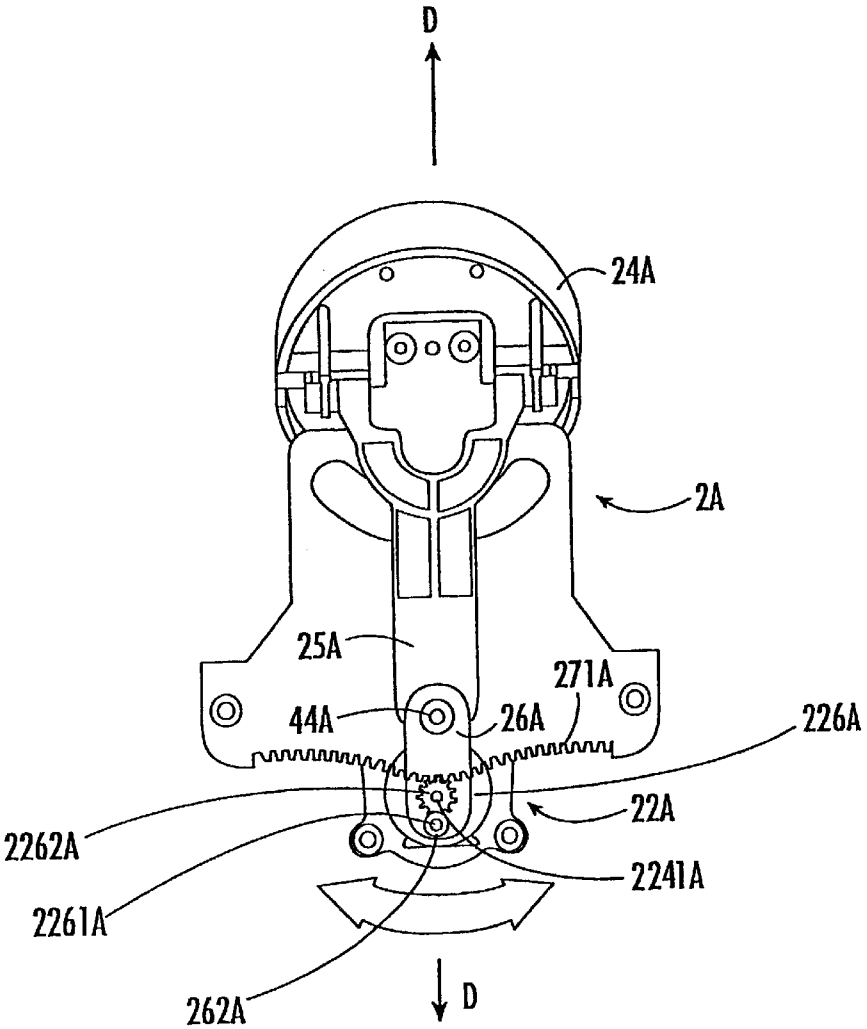
FIG. 14 is a rear schematic view of a head drive system according to further embodiments of the present invention, wherein the transmission assembly thereof is in a centered position.
Figure 15:
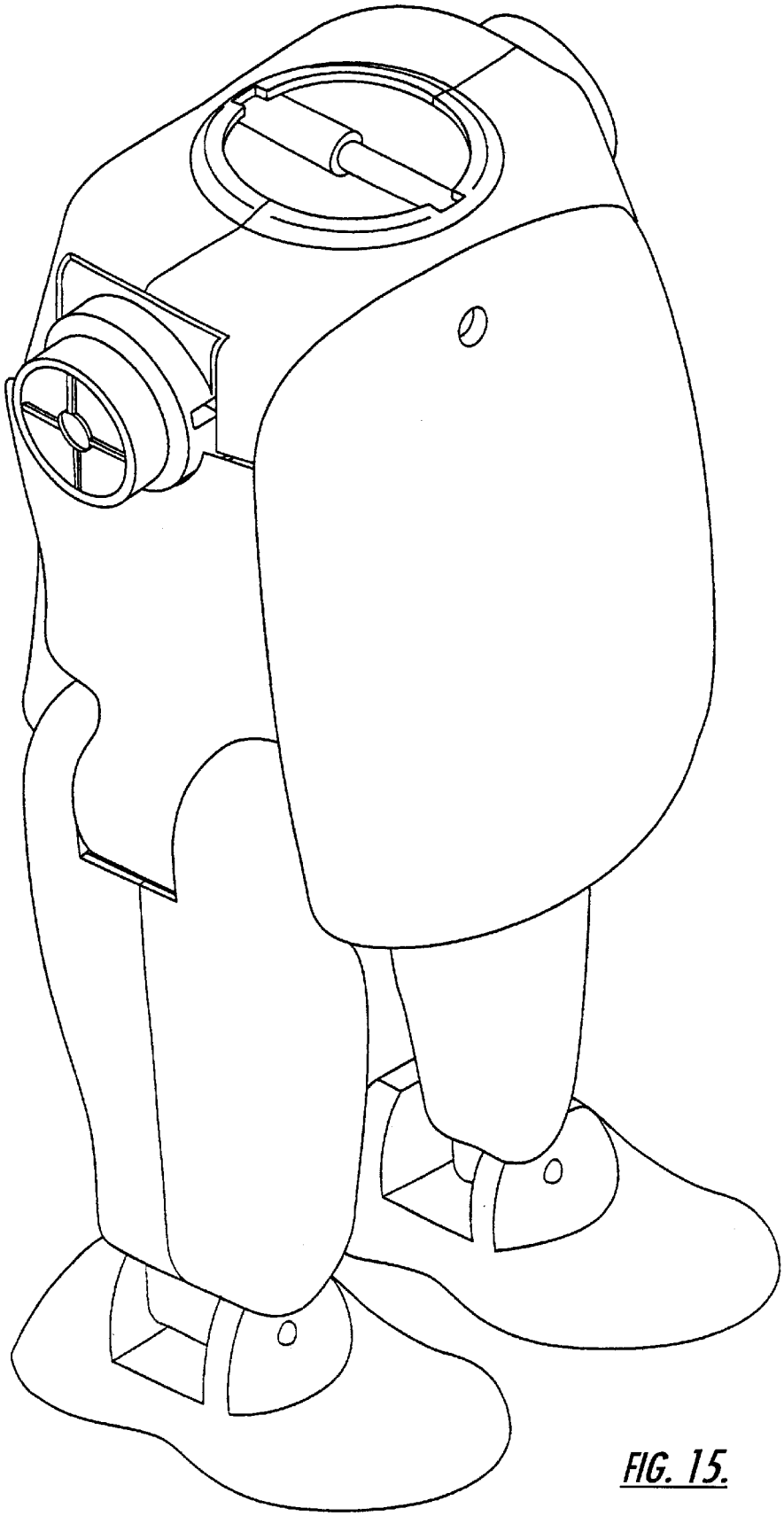
FIG. 15 is a perspective view of a toy according to the prior art.
Figure 16:
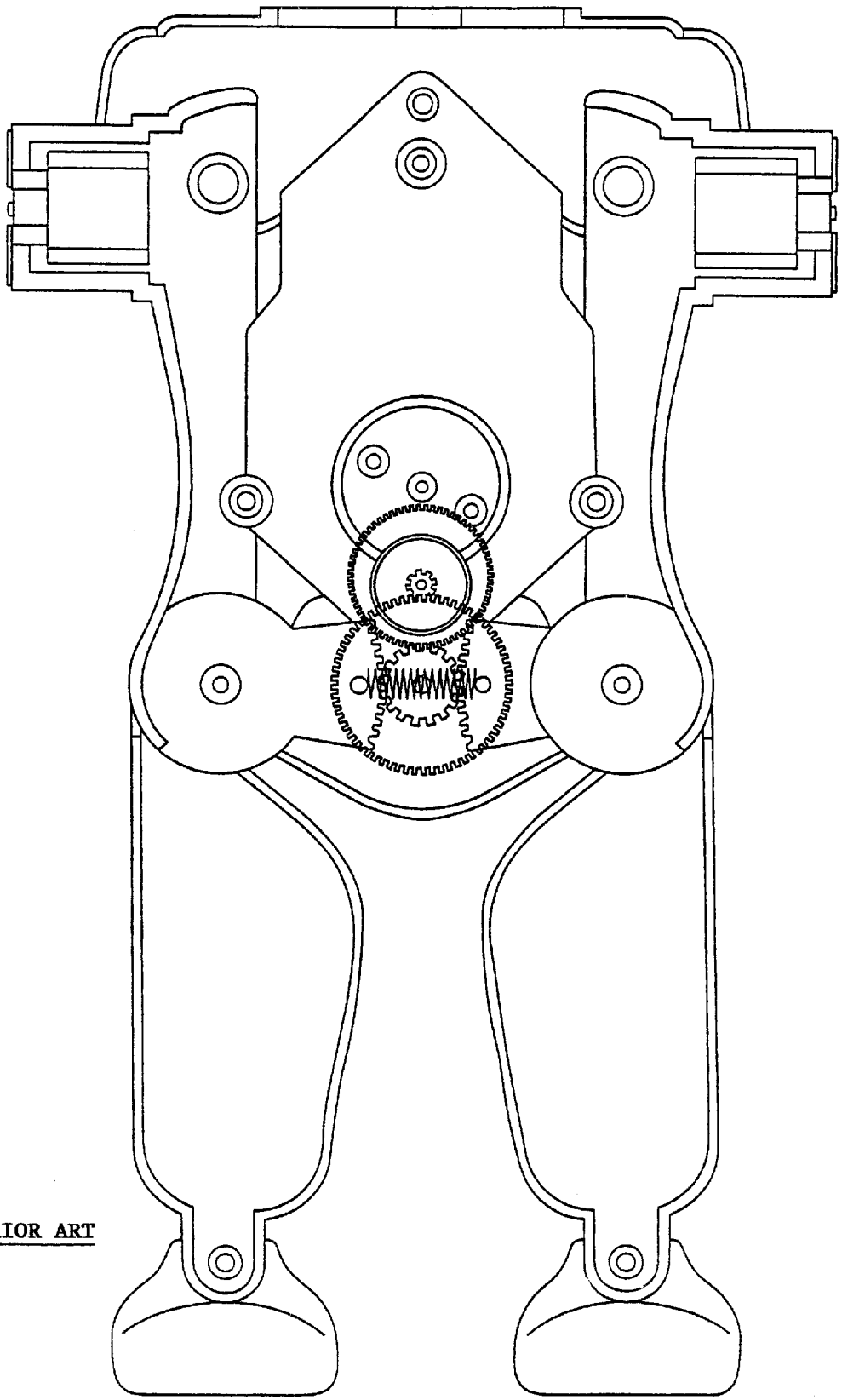
PRIOR ART FIG. 16.
FIG. 16 is a front elevational view of the toy of FIG. 15 illustrating internal mechanical components thereof.

With reference to FIG. 14, a head drive system 2A according to further embodiments of the present invention is shown therein. The head drive system 2A may be substituted for the head drive system 2 of the toy 10. The head drive system 2A is constructed and functions in the same manner as the head drive system 2 except as follows.

In place of the waveform rack rail 271, the transmission 22A of the head drive system 2A has a curved rack rail 271A, the profile of which is a uniform arc. The gear 2262A is located such that it is concentric with the drive rod 2241A that drives the wheel 226A. However, the pivot post 2261A is eccentrically located on the wheel 226A relative to the drive rod 2241A.

As the wheel 226A is driven via the drive rod 2241A, the gear 2262A revolves along the rack rail 271A causing the neck seat 24A to rotate side-to-side in the manner described above. As the wheel 226A rotates with the gear 2262A, the eccentric pivot post 2261A orbits the rotational axis (i.e., corresponding to the axis F—F) of the drive rod 2241A and pivots within the opening 262A in the linking member 26A. The vertical displacement of the pivot post 2261A relative to the drive rod 2241A causes the pivot post 2261A to drive the linking arm 25A upwardly and downwardly. The lateral displacement of the pivot post 2261A relative to the drive rod 2241A is accommodated by pivoting between the linking member 26A and the linking arm 25A about the pivot rod 44A.

The head drive system 2A provides a combination of movements similar to those provided by the head drive system 2. It will be appreciated by those of skill in the art from a reading of the description herein that the patterns and frequencies of up-and-down and side-to-side movements of the neck seat 24A as the wheel 226A traverses the rack rail 271A may be modified by modifying the diameter of the gear 2262A and/or relocating the pivot post 2261A on the wheel 226A.

The foregoing head and leg motions are preferably executed simultaneously. The frequencies and distances of these movements may be selected to simulate dancing, singing or the like. Moreover, the movements may be choreographed to music, for example, music from a suitable device which is actuated upon actuation of the motor 21 and/or the motor 32. Optionally, and as illustrated in FIG. 1, a speaker 14 may be provided in the stand 1. The frequencies of the respective motions may be different from one another.

The drive motors 21, 32 may be replaced with suitable non-electric drive means (e.g., wind up mechanical drivers).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A motion toy comprising:

a) a body member;

b) a head member mounted on said body member; and c) a head drive system operable to rotate said head member simultaneously up-and-down and side-to-side relative to said body member.

2. The motion toy of claim 1 wherein:

a) said head drive system is operable to rotate said head member side-to-side about a first axis and to simultaneously rotate said head member up-and-down about a second axis; and b) wherein said second axis is transverse to said first axis and varies as said head member rotates about said first axis.

3. The motion toy of claim 2 wherein said head drive system includes:

a) a stationary member;

b) a rocking member pivotally connected to said stationary member for relative rotation about said first axis, said rocking member including a head pivot post, wherein said head member is connected to said head pivot post for relative rotation about said second axis; and c) a drive unit operable to pivot said rocking member about said head pivot post relative to said stationary member about said first axis and to simultaneously rotate said head member relative to said rocking member about said second axis.

4. The motion toy of claim 3 wherein said head drive system includes:

a) a curved rack rail on said stationary member;

b) a wheel pivotally connected to said rocking member for rotation about a third axis, said wheel including:

a gear meshed with said rack rail for rotation therealong; and an eccentric pivot post extending from said wheel along a fourth axis substantially parallel to and offset from said third axis; and c) a linkage connecting said eccentric pivot post and said head member;

d) wherein said drive unit is operable to rotate said wheel about said third axis whereby said eccentric pivot post is rotated about said third axis and drives said head member up and down via said linkage.

5. The motion toy of claim 4 wherein said rack rail has a profile including a convex section and a concave section.

6. The motion toy of claim 4 wherein said rack rail has a uniformly arcuate, convex profile.

7. The motion toy of claim 4 wherein said linkage includes a linking arm that is driven up-and-down by said eccentric pivot post as said eccentric pivot post rotates about said third axis.

8. The motion toy of claim 7 wherein said linkage further includes a linking member joining and pivotally connected to each of said linking arm and said eccentric pivot post.

9. The motion toy of claim 7 wherein said linkage includes a rocker arm connected to said head member and pivotally connected to each of said linking arm and said head pivot post.

10. The motion toy of claim 1 wherein said head member includes a neck seat and a toy head attached to said neck seat.

11. The motion toy of claim 1 further including a leg drive system comprising:

a) a drive gear pivotally connected to said body member;

b) a leg member pivotally connected to said body member;

c) a linking arm connecting said drive gear and said leg member; and d) a drive unit operable to pivot said drive gear back-and-forth whereby said leg member is rocked relative to said body.

12. A motion toy comprising:

a) a body member;

b) a head member mounted on said body member;

c) a head drive system including:

1) a stationary member having a curved rack rail;

2) a rocking member pivotally connected to said stationary member for relative rotation about a first axis, said rocking member including a head pivot post, wherein said head member is connected to said head pivot post for relative rotation about a second axis transverse to said first axis;

3) a wheel pivotally connected to said rocking member for rotation about a third axis, said wheel including:

a gear meshed with said rack rail for rotation therealong; and an eccentric pivot post extending from said wheel along a fourth axis substantially parallel to and offset from said third axis; and 4) a linkage connecting said eccentric pivot post and said head member, said linkage including:

a linking arm;

a rocker arm connected to said head member and pivotally connected to each of said linking arm and said head pivot post; and a linking member joining and pivotally connected to each of said linking arm and said eccentric pivot post; and d) a drive unit operable to rotate said wheel about said third axis;

e) wherein, as said wheel rotates about said third axis:

said gear rolls along said rack rail and said rocking member pivots about said first axis to rotate said head member side-to-side about said first axis; and, simultaneously, said eccentric pivot post drives said linking arm up-and-down and said rocker arm pivots about said head pivot post to rotate said head member up-and-down about said second axis; and f) wherein said second axis varies as said head member rotates about said first axis.

13. The motion toy of claim 12 wherein said rack rail has a profile including a convex section and a concave section.

14. The motion toy of claim 13 wherein said rack rail has a uniformly arcuate, convex profile.

15. The motion toy of claim 12 wherein said head member includes a neck seat and a toy head attached to said neck seat.

16. The motion toy of claim 12 further including a leg drive system comprising:

a) a drive gear pivotally connected to said body member;

b) a leg member pivotally connected to said body member;

c) a linking arm connecting said drive gear and said leg member; and d) a drive unit operable to pivot said drive gear back-and-forth whereby said leg member is rocked relative to said body.

* * * * *